United States Patent [19]

Aigo

[11] 4,137,867

[45] Feb. 6, 1979

[54] APPARATUS FOR BUMP-PLATING SEMICONDUCTOR WAFERS

[76] Inventor: Seiichiro Aigo, 3-15-13 Negishi, Daito-ku, Tokyo, Japan

[21] Appl. No.: 832,332

[22] Filed: Sep. 12, 1977

[51] Int. Cl.[2] ..... B05B 5/02; B05C 5/00

[52] U.S. Cl. ..... 118/627; 118/64

[58] Field of Search ..... 118/DIG. 23, 627–629, 118/63, 58, 64, 69, 659; 427/15–17, 13, 27, 28

[56] References Cited

U.S. PATENT DOCUMENTS

| | | | |
|---|---|---|---|
| 2,953,483 | 9/1960 | Torok | 118/504 X |
| 3,417,734 | 12/1968 | Simm et al. | 427/15 X |
| 3,435,802 | 4/1969 | Nail | 427/16 X |
| 3,557,752 | 1/1971 | Hakanson | 427/15 X |

OTHER PUBLICATIONS

*IBM Technical Disclosure Bulletin*, "Cooling Ion-Implantation Target" Hammer, vol. 19, No. 6 (Nov. 1976) pp. 2270–2271.

*Primary Examiner*—Morris Kaplan

[57] ABSTRACT

An apparatus for bump-plating on one surface of a semiconductor wafer, in which the upper surface of a horizontally set semiconductor wafer that is not to be plated has a gas, blown thereon preferably with an inert gas, and the lower surface of the wafer is contacted with plating liquid that is blown vertically upward, to thereby prevent the non-plated surface from being contacted by with the plating liquid without usage of any coatings such as photoresist to being applied thereon so as to facilitate the bump-plating of semiconductor wafers.

15 Claims, 5 Drawing Figures

APPARATUS FOR BUMP-PLATING SEMICONDUCTOR WAFERS

BACKGROUND OF THE INVENTION

This invention relates to an improvement of an apparatus for bump-plating with gold, silver or the like on one surface of a semiconductor wafer.

In a commonly accepted technique for bump-plating only one surface of a semiconductor, the other surface that was not to be plated was coated with a coating such as photoresist, wax or the like and was held with pins at several portions of the periphery of the wafer to be dipped in a plating liquid. And after bump-plating, the coating such as photoresist was taken off of the wafer surface. Thus, extra steps and related difficulties resulted.

SUMMARY OF THE INVENTION

Therefore, the object of the invention is to provide an improved apparatus for bump-plating one surface of a semiconductor wafer, in which the other wafer surface not to be plated is effectively prevented from contacting the plating liquid without usage of any coatings such as photoresist or the like to be coated on the non-plated surface.

Another object of the invention is to provide an improved bump-plating apparatus for semiconductor wafers, in which the wafers to be plated are retained easily as well as securely.

In attaining the described objects of the invention, a bump-plating apparatus according to the present invention includes a plurality of plating basins within a container and holder movable relative to and above the basins, the semiconductor wafers to be plated being set horizontally between the basins and the holders. An inert gas is blown downwardly on the upper surface of the wafer to prevent it from contacting the plating liquid, and the lower surface is plated in a bump-plating system with plating liquid which is blown up against the lower wafer surface.

The invention and its objects and advantages will become more apparent in the detailed description of the preferred embodiments of the invention.

BRIEF DESCRIPTION OF THE DRAWING

In the detailed description of the preferred embodiments presented below, reference is made to the accompanying drawing in which.

DESCRIPTION OF THE PREFERRED EMBODIMENTS

Figure 1:
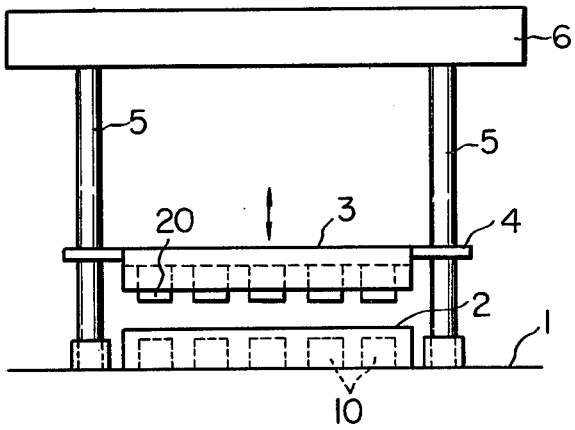
FIG. 1 is a side elevational view showing schematic substantially the entirety of an apparatus for bump-plating semiconductor wafers embodied by the present invention.
Figure 2:
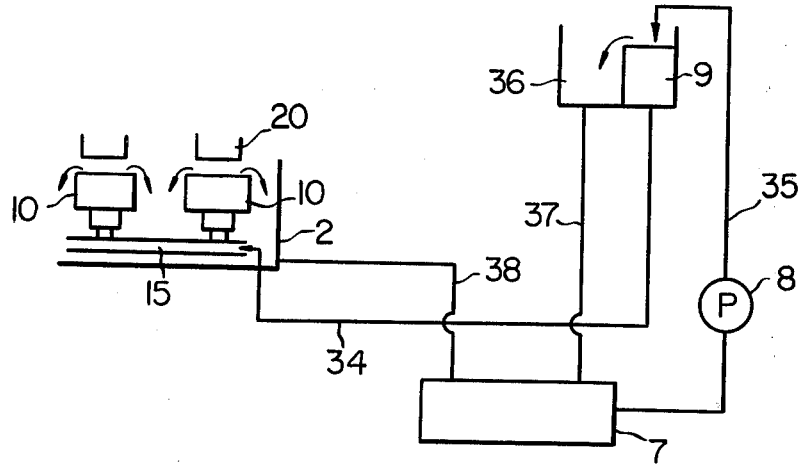
FIG. 2 is a schematic view of a plating system of the apparatus.

Referring now to FIG. 1, a bump-plating apparatus according to the invention includes a container 2 secured on a base 1 and a cover 3 which is vertically movable relative to above the container. This cover 3 is guided vertically by means of opposed, laterally extending flanged portions 4 thereof, openings being formed in the respective flanged portions 4 for movably engaging respective guide bars 5. These guide bars are secured between base 1 and a ceiling 6. A system of the apparatus, as shown in FIG. 2, has a tank 7 for a plating liquid, a pump 8 and a sump 9 outside the container 2. The container 2 includes therein a plurality of essentially cup-shaped plating basins 10 disposed on the same level, for example, 5 lines × 5 rows equalling 25 of the basins 10 being included. Also, the cover 3 has the same number of holders 20 secured thereto in position corresponding to the respective basins.

Figure 3:
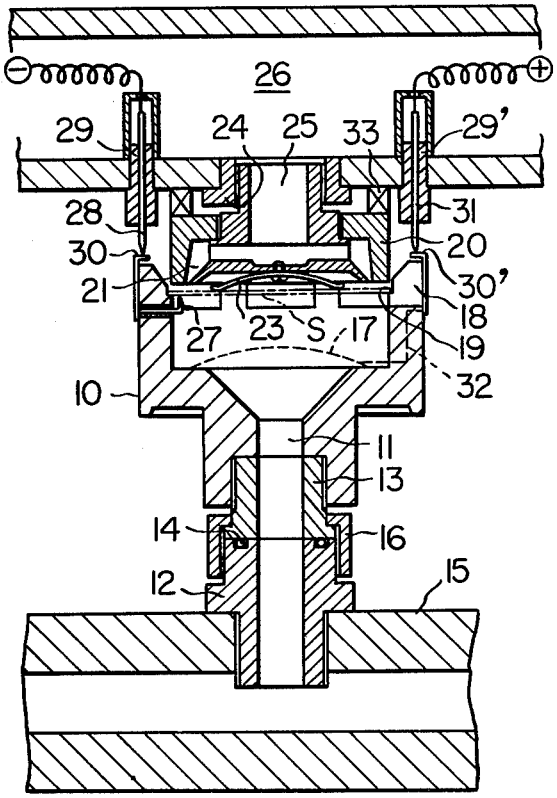
FIG. 3 is a vertical sectional view of a set of a plating basin and a cooperating holder provided thereabove contained in the apparatus.
Figure 4:
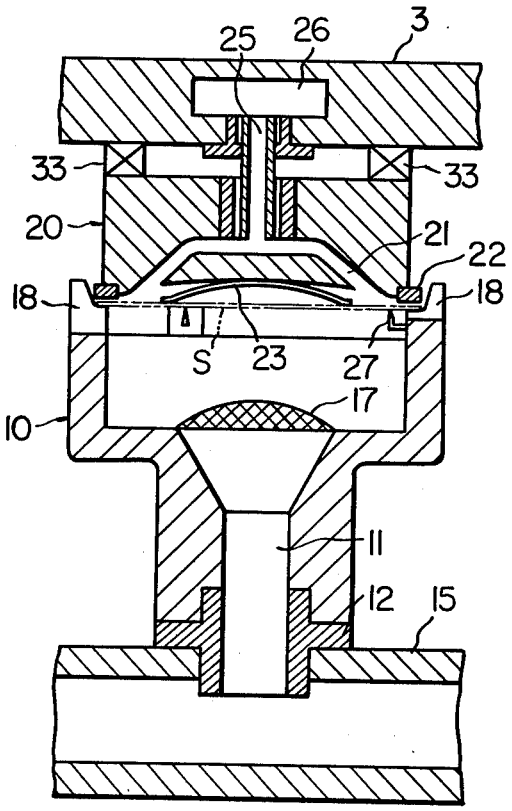
FIG. 4 is a vertical sectional view similar to FIG. 3 showing another embodiment of the present invention.

Plating basins 10 may be normally made of polypropylene, and as shown in FIGS. 3 and 4, the longitudinal axis of each basin 10 is vertical to a horizontally set semiconductor wafer S. Lower portion of the basin is of a tubular form provided with a central passage 11. The passage 11 is connected at the lowermost portion thereof with a common conduit 15 disposed in container 2 by means of adapter 12, sleeve 13 and O-ring 14 located therebetween. This passage 11 serves to blow a plating liquid in an upward direction. In this respect, the adapter 12 and sleeve 13 are interconnected preferably with a cap nut 16 to thereby fix the plating basin 10 at an adequate angular position. A mesh-shaped anode 17 is provided on the top of passage 11 of the basin 10. The periphery of plating basin 10 is normally circular and a plurality of equally spaced apart integral protrusions 18 are formed on the peripheral top of the basin 10. Each protrusion 18 is formd with a step 19 on its inner surface at the same level in order to set horizontally a semiconductor wafer to be plated. The inner surfaces of respective protrusions 18 are preferably slant divergently upwards, as shown in FIGS. 3 and 4, to thereby facilitate still more the setting of a semiconductor waferS.

The periphery of holder 20 is circular similarly to basin 10. The bottom of holder 20 includes a nozzle 21 and, if desired, a ring shaped resilient member 22 may also secured on the lowermost outer periphery of holder 20 as shown in FIG. 4. Also, the bottom surface of holder 20 is provided with a spring, preferably a curved leaf spring 23, to thereby hold resiliently and securely semiconductor wafer S with a downward resilient force as well as to thereby prevent the wafer from adhering to the bottom of holder 20 when removed. Respective holders 20 are fixed in cover 3 with bushings 24 and have a gas passage 25 formed axially therein communicating with nozzle 21. The top of passage 25 is connected to a common gas passage 26 provided in the cover 3.

Figure 5:
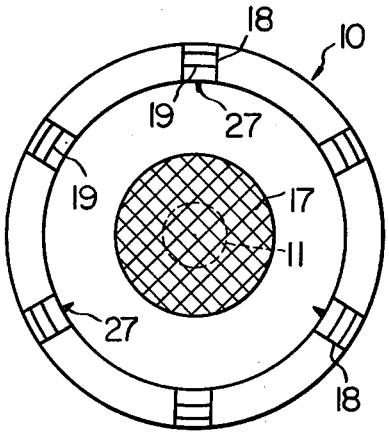
FIG. 5 is a plan view of a plating basin contained in the bump-plating apparatus.

Wafer contact electrodes 27 are cathodes and there are preferably a plurality of them, for example as shown in FIG. 5, three teflon-coated lead wires mounted on the top periphery of plating basin 10. The tip portion of each wafer contact electrode 27 is directed upwardly and is sharply pointed. The tip portion of each wafer contact electrode projects upwardly slightly more than the step 19 of protrusion 18 so as to gnaw into the lower or downwardly facing surface of a set wafer S. Cathode bar 28 is mounted on cover 3 with supporting rod 29 and connected with the respective contact electrodes 27 through lead pieces 30 positioned on protrusions 18. Similarly, anode bar 31 mounted on cover 3 with supporting rod 29′ is connected with mesh-shaped anode 17 through a similar lead piece 30′ on a protrusion 18 and a lead wire 32. Cushions 33 are provided between respective holders 20 and cover 3.

Further, as shown in FIG. 2 sump 9 is located on a higher level than container 2 and connected to common conduit 15 within the container through pipe line 34. Tank 7 and sump 9 are interconnected by pipe line 35 in which pump 8 is included. Sump 9 is provided with a conduit portion 36 which is connected to tank 7 through pipe line 37. The bottom of container 2 is connected to tank 7 through pipe line 38.

In operation, plating liquid contained in tank 7 is introduced into sump 9 by means of pump 8. A portion of plating liquid in sump 9 overflows into conduit portion 36 and then returns to tank 7. The remaining plating liquid in sump 9 is inserted into the respective plating basins 10 from the bottom thereof through pipe line 34 and common conduit 15, and passes through mesh-shaped anode 17, blowing up against the lower or downwardly facing surface of a set semiconductor wafer S. Thereafter, plating liquid flows out through spaces defined between protrusions 18 on the top periphery of plating basin 10 and falls down in container 2 from which the liquid returns to tank 7 through pipe line 38. Accordingly, since plating liquid blows up from a lower level by a substantially constant pressure into plating basin 10, it will be stirred up enough. In this respect, discharge side of pump 8 will be directly connected to common conduit 15, if desired. Also, in this bump-plating apparatus, because semiconductor wafers are set horizontally, they are contacted uniformly with plating liquid.

When a semiconductor wafer S is disposed on steps 19 of protrusions 18 and held by a relevant holder 20 positioned thereabove, the upper non-plated surface of a wafer is retained by leaf spring 23. In this condition, pressurized gas, preferably an inert gas such as $N_2$gas, blows out from nozzle 21 through gas passages 26 and 25 and then jets out through spaces between the set wafer and the holder. This prevents the upper surface, i.e., non-plated surface of a wafer S from contacting with plating liquid.

Therefore, according to the present invention, because a jet or blow of pressurized gas prevents a non-plated wafer surface from contacting the plating liquid, it is not required to apply a coating such as photoresist on the non-plated wafer surface for bump-plating only one surface of a wafer. In addition, this arrangement enables easy and secure setting of semiconductor wafers to be plated. Thus, this invention reduces some steps in a bump-plating process for semiconductor wafers and does not require any coatings such as photoresist or the like, which serves to save cost.

The present invention may be embodied in other forms or carried out in other ways without departing from the spirit or essential characteristics thereof. The present embodiments are therefore to be considered as in all respects illustrative and not restrictive, the scope of the invention being indicated by the appended claims, and all changes which come within the meaning and range of equivalency are intended to be embraced therein.

We claim:

1. An apparatus for bump-plating only one surface of semiconductor wafers, said apparatus comprising:

a container;

a plurality of cup-shaped plating basins secured within said container;

each said basin including means for supporting a wafer in a horizontal plane and passage means extending therethrough, one end of said passage means being in communication with the downwardly facing surface of the supported wafer, the other end of said passage means being in communication with a source of plating liquid whereby the plating liquid may be blown upwardly through the passage means and against the downwardly facing surface of the supported wafer;

a cover positioned in opposition and movable vertically with respect to said container;

a plurality of holders secured in said cover with each of said holders being aligned and engagable with a respective one of said plating basins;

each said holder including passage means therethrough, one end of said passage means being in communication with the upwardly facing surface of the supported wafer, the other end of said passage means being in communication with a source of pressurized gas whereby the pressurized gas may be blown downwardly through the passage means and against the upwardly facing surface of the supported wafer; and cathode and anode means positioned in each said basin, a portion of each said cathode means being in electrical contact with the supported wafer.

2. The apparatus according to claim 1 wherein said passage in each said holder and in each said basin is axially oriented in a substantially vertical plane.

3. The apparatus according to claim 1 wherein there is further included conduit means communicating with said passage in each said basin.

4. The apparatus according to claim 1 wherein said means for supporting the wafers comprises a plurality of of angularly spaced apart protrusions extending from the periphery of each said basin.

5. The apparatus according to claim 4 wherein each said protrusion includes a step for seating the wafer, said steps being in a common horizontal plane.

6. The apparatus according to claim 5 wherein each said protrusion includes an angled surface that diverges from a plane perpendicular to the horizontal plane in a direction away from said step.

7. The apparatus according to claim 5 wherein said portion of said cathode is sharply pointed and postioned slightly above said common horizontal plane.

8. The apparatus according to claim 1 further including means for pumping the plating liquid.

9. The apparatus according to claim 1 wherein said anode means is in the form of a mesh.

10. The apparatus according to claim 9 wherein said anode means extends across said passage in each said basin.

11. The apparatus according to claim 9 wherein the end of said passage in said basin adjacent said anode is funnel-shaped.

12. The apparatus according to claim 1 wherein said passage in each said holder includes a nozzle portion.

13. The apparatus according to claim 1 wherein each said holder includes spring means for resiliently engaging the upper surface of the supported wafer.

14. The apparatus according to claim 13 wherein said spring means comprises a leaf spring.

15. The apparatus according to claim 1 further including a resilient, ring-like member on each holder for engaging the periphery of the upper surface of the supported wafer.

* * * * *